United States Patent [19]

Kamio et al.

[11] Patent Number: 4,609,412

[45] Date of Patent: Sep. 2, 1986

[54] AL-KILLED COLD-ROLLED STEEL SHEET WITH EXCELLENT DEMAGNETIZATION CHARACTERISTICS AND PROCESS FOR PRODUCING THE SAME, AND SHADOW MASK AND COLOR TELEVISION USING THE SAME

[75] Inventors: Morinori Kamio; Masahiro Tsuji; Susumu Kawauchi; Jun Ono; Hideki Isayama, all of Samukawa; Akihiko Nishimoto, Fukuyama; Yoshiharu Miyawaki, Fukuyama; Osamu Nozoe, Fukuyama; Koji Iwase, Fukuyama, all of Japan

[73] Assignees: Nippon Mining Co., Ltd; Nippon Kokan Kabushiki Kaisha, both of Tokyo, Japan

[21] Appl. No.: 704,804

[22] Filed: Feb. 25, 1985

[30] Foreign Application Priority Data

Feb. 28, 1984 [JP] Japan ..... 59-35328
Jul. 23, 1984 [JP] Japan ..... 59-151429

[51] Int. Cl.[4] ..... C21D 9/52

[52] U.S. Cl. ..... 148/12 C; 148/12.1; 148/320

[58] Field of Search ..... 148/12 C, 12.1, 36

[56] References Cited

U.S. PATENT DOCUMENTS 4,325,752 4/1982 Suda et al. ..... 148/12.1

*Primary Examiner*—Wayland Stallard

*Attorney, Agent, or Firm*—Seidel, Gonda, Goldhammer & Abbott

[57] ABSTRACT

An Al-killed cold-rolled steel sheet with excellent demagnetization characteristics is provided which is substantially consisted of 0.005% or less C; from 0.05 to 0.50% Mn; 0.010% or less S; from 0.01 to 0.08% Sol.Al; 0.0050% or less N; wherein Mn %/S %≧7 and (Sol.Al % - 0.003%)/N %≧6; and the remainder iron and inevitable impurities. A shadow mask made of such Al-killed cold-rolled steel sheet and a color television receiver using the same exhibit a very excellent function. A preferred process for producing such an Al-killed cold-rolled steel is also provided, said process being characterized in first obtaining a steel or a specific composition by the use of a vacuum degassing apparatus and then subjecting the steel to sequential steps of hot rolling, cold rolling, decarburization-annealing, and cold rolling.

3 Claims, No Drawings

AL-KILLED COLD-ROLLED STEEL SHEET WITH EXCELLENT DEMAGNETIZATION CHARACTERISTICS AND PROCESS FOR PRODUCING THE SAME, AND SHADOW MASK AND COLOR TELEVISION USING THE SAME

FIELD OF THE INVENTION

This invention relates to an Al-killed cold-rolled steel sheet with excellent demagnetization characteristics and a process for producing the same and also relates to a shadow mask and a color television using the same.

BACKGROUND OF THE INVENTION

As materials of shadow masks to be used in cathode-ray tubes for color television and color display, low-carbon, rimmed, cold-rolled steel sheets have hitherto been employed. However, such low-carbon, rimmed, cold-rolled steel sheets have disadvantages, for example, in that nonmetallic inclusions or carbides in the steel can cause unregulated contours of the mask holes when they are made by photoetching and in that low-temperature annealing performed inevitably to prevent adhesion of flat masks to each other in the final annealing will make the crystal grain size so small that levelling prior to press forming will not thoroughly strain the sheet and stretcher strains tend to develop due to yield point elongation caused by solid-soluted C and N during the press work. Development of these stretcher strains, which deform the hole contours and uneven color development, must be avoided to satisfactorily function the shadow mask.

Another problem with rimmed steels is that annealing at elevated temperatures coarsens the crystal grains, thus again deforming the contours of the mask holes on press working of the shadow masks. To overcome these difficulties, variations of steel compositions and final annealing conditions must be strictly controlled.

In an effort to lessen these disadvantages, low-carbon Al-killed cold-rolled steel sheets with a C content of 0.005% or below are recently coming to use.

Problems of the Prior Art

The shadow mask not only controls the electron beams for color reproduction but also serves as a magnetic shield inside a cathode-ray tube to keep the paths of electron beams from being undesirably deflected by external magnetic fields such as of the earth magnetism. It thus avoids reduction of color purity or uneven color reproduction due to mislanding, a phenomenon in which the electron beam paths in the color cathode-ray tube are distorted by variations in the horizontal component of the earth magnetism, making it no longer possible for the electron beam spots on the phosphor screen and the phosphor locations on the screen to maintain precise alignment. Thus, in an ordinary color cathode-ray tube, the drift spaces of the electron beams are isolated from external magnetic influences by the magnetic shield, and the demagnetization characteristics of the shadow mask itself also are important.

In respect of the demagnetization characteristics, the low-carbon, Al-killed cold-rolled steel sheet is inferior to the low-carbon, rimmed cold-rolled steel sheet. Problems arise from its use in forming a shadow mask, such as the necessity of a special circuit to improve the landing characteristics in the cathode-ray tube.

Thus, it is essential that the shadow mask itself has excellent demagnetization characteristics. The existing low-carbon, Al-killed cold-rolled steel sheets are unsatisfactory for the application, and a steel sheet of this type with greater demagnetization characteristics than usual has been desired.

The Object of the Invention

The object of this invention is to provide a low-carbon Al-killed cold-rolled steel sheet with excellent demagnetization characteristics which meets the demand described above. Further, this invention has an object of establishing a process effective to produce such low-carbon Al-killed cold-rolled steel sheet.

Explanation of the Invention

The present inventors have made diversified investigations in view of the foregoing and have now found that excellent demagnetization characteristics are accomplished in an Al-killed cold-rolled steel sheet substantially consisted of (all percentages herein being by weight) 0.005% or less, preferably 0.004% or less C; from 0.05 to 0.50%, preferably 0.1 to 0.50%, Mn; 0.010% or less S; from 0.01 to 0.08%, preferably 0.02 to 0.08% Sol.Al (acid-soluble Al); 0.0050% or less N; wherein (Sol.Al % - 0.003%)/N %$\geqq$6; and the remainder iron and inevitable impurities. Accordingly, a shadow mask fabricated from such Al-killed cold-rolled steel sheet and a cathode-ray tube for a color television, color display, etc. using such shadow mask exhibit a very excellent function.

Although the above Al-killed cold-rolled steel sheet may be produced by ordinary processes, the present invention is based on the discovery that one effective production process is to produce it by first obtaining a steel of a specific composition by the use of a vacuum degassing apparatus and then subjecting the steel to sequential steps of hot rolling, cold rolling decarburization-annealing, and cold rolling.

In the above process, the composition of the steel produced by the use of a vacuum degassing apparatus is substantially consisted of, all by weigh, 0.008% or less C; from 0.05 to 0.50% Mn; 0.010% or less S; from 0.010 to 0.080% Sol.Al; 0.005% or less N; and the remainder iron and inevitable impurities, the ranges being so confined as to satisfy the relations Mn(%)/S(%)$\geqq$7 and (Sol.Al(%) - 0.003)/N(%)$\geqq$6.

A molten steel having a composition of the range described above is cast by ordinary ingot casting or continuous casting into a steel piece, and the steel piece is subjected to a series of hot rolling, descaling, cold rolling, surface cleaning and other treatments, and then decarburized in a decarburizing-annealing furnace while avoiding nitrogen absorption until the C content decreases to not more than 0.005%, preferably not more than 0.004%. The steel is again cold-rolled into a sheet of 0.2 mm or less in thickness.

Annealing this Al-killed cold-rolled steel sheet once or more before its fabrication into shadow masks will give products with excellent demagnetization and picture characteristics.

This process differs markedly from the conventional methods in that after in its steel making and ingot making processes decarburization and cleaning treatment are effected with a vacuum degassing apparatus, decarburization treatment is again effected in its annealing process. The decarburization by the degassing apparatus is intended to eliminate the carbide ($Fe_3C$) in the stage of hot rolling, to promote the growth of crystal grains to a larger size for improved demagnetization characteristics during the hot rolling and subsequent steps. The decarburization in the annealing furnace is aimed at minimizing the C content in steel or reducing the solid-soluted C content before press forming to a percentage low enough to prevent the possible stretcher strain during the forming process.

As will be obvious from the foregoing, the addition of Nb, Ti or other element with the view to fixing the solid-soluted C is objectionable for the purposes of the invention, because they form fine carbide particle precipitates which deteriorate the demagnetization characteristics of the product.

The reasons for which the contents of the elements according to the invention are confined within the specified ranges will now be explained.

C:- As described above, too large a C content in cold-rolled steel would lead to iron carbide formation, which has deleterious effects upon the demagnetization characteristics, hindering reduction of the coercive force in particular. Also, the solid-soluted C content must be low enough when the flat masks of the sheet are annealed after they have perforated for the manufacture of shadow masks; otherwise, uneven forming (development of stretcher strains) will result from the subsequent press forming. In order to meet the both requirements, the C content in the Al-killed cold-rolled steel sheet must have an upper limit of 0.005%, preferably 0.004%. When the C content is within this range, the solid-soluted C content is satisfactorily low and there is no possibility of a very small amount of C precipitating at the crystal grain boundaries on final annealing and thereby deteriorating the demagnetization characteristics. On the other hand, the C content in the stage of steel making should be 0.008% or below so as to adequately accelerate the grain growth during hot rolling and also during the early period of decarburization-annealing and to coarsen the particles of the precipitate.

For these reasons, the C content in the cold-rolled steel sheet is specified to be 0.005% or below, preferably 0.004% or below and that in the steel before the hot rolling to be 0.008% or below.

Mn:- In addition to achieving a deoxidation action, Mn helps to increase the strength of steel without affecting adversely the various characteristics of the resulting shadow mask. As another role, Mn plays is to combine with S in the steel to prevent red shortness of the steel. For these purposes at least 0.05 %, preferably at least 0.10% Mn is required. In addition, with respect to the weight ratio of Mn to S, it is more suitable that a relation of $Mn(\%)/S(\%) \geqq 7$ is satisfied. However, if the Mn content exceeds 0.50%, the resulting flat masks are too hard to form into shadow masks. Therefore, Mn is specified to be in the range from 0.05 to 0.50%, preferably 0.10 to 0.50%, and $Mn(\%)/S(\%) \geqq 7$.

S:- S in steel produces MnS inclusions, which hamper the growth of recrystallized grains in the cold-rolled steel. These undergrown small grains and minute MnS particles themselves deteriorate the demagnetization characteristics. When S is in excess of 0.010%, the demagnetization characteristics is poor regardless of the hot rolling, annealing and other conditions. The S content should therefore be confined to 0.010% or downwards. It is to be noted that in ingot making by continuous casting, electromagnetic stirring has been found to be additionally beneficial in that it prevents segregation of MnS distribution in the center of the steel ingot.

Sol.Al:- An Al content in the form of Sol.Al (acid-soluble Al) is necessary in order to fix solid-soluted N as AlN and prevent stretcher strains during press forming, aside from its main action to deoxidize the steel and lower its content of inclusions. An excessive content not only deteriorates the ductility but allows the steel to absorb $N_2$ from the atmosphere during the annealing to increase the absolute AlN content and thereby impair the demagnetization characteristics.

For the sake of deoxidation 0.010% or more, preferably 0.02% or more Sol.Al is required but the upper limit is fixed to 0.080% in consideration of the ductility and nitrogen absorption. Also, in order to coarsen the AlN particles during annealing sufficiently to avoid deterioration of the demagnetization characteristics with the formation of fine AlN particles, available Sol.Al in a percentage at least six times that of N is desirable. On conducting analysis, a certain amount of fine $Al_2O_3$ and composite aluminum oxides are unavoidably included in the analyzed Sol.Al amount. It is appropriate, therefore, that the analytical value of Sol.Al minus 0.003% divided by the percentage of N equals 6 or more.

N:- As stated above, N combines with Sol.Al in steel to form AlN, the fine particles of which deteriorate the demagnetization characteristics. Hence, the N content in the cold-rolled steel sheet is limited to 0.0050% or less, preferably 0.0040% or less.

The molten steel of the foregoing composition is prepared in the following way. After tapping from a converter, the melt is decarburized by a degassing refining apparatus to a C content of 0.008% or less, and then Al or the like is added to prepare an Al-killed steel. At this time, refining outside the furnace is effective for enhancing the cleanness rate of the steel. While casting may be performed by the usual ingot making process, continuous casting with electro-magnetic stirring gives a steel of better quality. The reason therefore is that segregation of MnS distribution in the center of the ingot is prevented. After hot rolling under prescribed conditions, cold rolling is carried out, followed by open-coil decarburization-annealing. For this decarburization-annealing, care should be taken to limit the $NH_3$ content in the ambient atmosphere to 15 ppm or less, a level low enough to prevent nitrogen absorption by the steel. Although the decarburized steel is desired to have the lowest possible C content, excessive decarburization must be avoided because the consequent internal oxidation of the grain boundaries has an adverse effect on the demagnetization characteristics. For satisfactory demagnetization characteristice 0.005% or less, preferably 0.004% or less C is adequate. When carburization is expected to result from the final prepressing annealing for the manufacture of shadow masks, it is advisable to allow for it and accordingly reduce the C content to a lower level.

After the decarburization-annealing, it is desirable to carry out skin-pass rolling or roller levelling before the steel is cold-rolled again. The secondary cold rolling gives a sheet of a thickness required by the shadow mask manufacturer.

Final annealing of the Al-killed cold-rolled steel sheet made in this way finishes it as a steel sheet with excellent demagnetization characteristics. Consequently, the shadow mask and the color television receiver using it both attain improved landing characteristics.

EXAMPLE

For the preparation of test pieces, low carbon steel was tapped from a 150-ton converter, refined through decarburization by an RH degassing unit down to 0.005% C, and, following compositional adjustments with the addition of Fe-Mn and Al, cast by continuous casting into ingots. A total of seven charges were tapped. The C contents after the casting varied from 0.005 to 0.008% due to pickup from the composition-adjusting additives and casting powders.

The steel workpieces were passed through sequential steps of hot rolling, pickling, cold rolling, decarburization annealing, skin-pass rolling, and another cold rolling to form thin sheets 0.15 mm in thickness.

The compositions of these cold-rolled steels are given in Table 1.

The test pieces were annealed, in an atmosphere of 8% $H_2$ and the balance $N_2$ with a dew point of 0° C., at 700° C. for 10 minutes. Following furnace cooling, their magnetic characteristics were determined. The demagnetization characteristics were represented by the coercive force, Hc.

As the coercive force, Hc, values also shown in Table 1 indicate, the steels I of the invention, test pieces A through D having the Hc values ranging from 0.9 to 1.1 Oe, were superior in demagnetization characteristics to comparative steels E to G having the Hc values ranging from 1.4 to 1.5 Oe. It is known from experience that lower Hc is more prefered, and an Hc value in excess of 1.4 Oe of a shadow mask has some adverse influence on the characteristics of the color cathode-ray tube incorporating the mask.

Among the comparative steels I, the test pieces E and F showed high Hc values by virtue of the large S content and S and N contents, respectively, whereas test piece G had a larger N content due to nitrogen adsorption during annealing.

Two charges of steels II, H and I according to the invention, were likewise tapped from a converter but directly cast continuously without subjection to the RH degassing treatment. The C contents of the hot-rolled plates were 0.04% and 0.06%, respectively. From the casting stage onward, the two steels were passed through the same sequential steps. It will be seen that the omission of the degassing-decarburization treatment kept their Hc values high. But, their Hc values of 1.3 are allowable.

TABLE 2

| | Test piece | C | Mn | S | SolAl | N | Hc (Oe) |
|---|---|---|---|---|---|---|---|
| Steels of the invention I | A | 0.0016 | 0.14 | 0.006 | 0.054 | 0.0012 | 0.9 |
| | B | 0.0021 | 0.13 | 0.003 | 0.040 | 0.0030 | 1.0 |
| | C | 0.0018 | 0.25 | 0.009 | 0.036 | 0.0032 | 1.1 |
| | D | 0.0020 | 0.16 | 0.005 | 0.064 | 0.0040 | 1.2 |
| Comparative steels I | E | 0.0018 | 0.19 | 0.021 | 0.015 | 0.0030 | 1.4 |
| | F | 0.0011 | 0.18 | 0.018 | 0.050 | 0.0065 | 1.5 |
| | G | 0.0020 | 0.24 | 0.007 | 0.085 | 0.0086 | 1.6 |
| steels of the invention II | H | 0.0010 | 0.17 | 0.006 | 0.060 | 0.0018 | 1.3 |
| | I | 0.0015 | 0.20 | 0.008 | 0.041 | 0.0020 | 1.3 |

What is claimed is:

1. An Al-killed cold-rolled steel sheet with excellent demagnetization characteristics consisting essentially of 0.004% or less C; from 0.005 to 0.50% Mn; 0.010% or less S; from 0.01 to 0.08% Sol.Al; 0.0040% or less N; wherein Mn %/S %≧7 and (Sol.Al % - 0.003%)/N %≧6; the remainder iron and inevitable impurities.

2. A shadow mask having an Al-killed cold-rolled steel sheet with excellent demagnetization characteristics which consists essentially of 0.004% or less C; from 0.05 to 0.50% Mn; 0.010% or less S; from 0.01 to 0.08% Sol.Al.; 0.0040% or less N; wherein Mn %/S %≧7 and (Sol.Al % - 0.003%)/N %≧6; the remainder iron and inevitable impurities.

3. A process for producing an Al-killed cold-rolled steel sheet with excellent demagnetization characteristics for shadow masks characterized in comprising the steps of preparing a molten steel with the use of a vacuum degassing apparatus which consists essentially of 0.008% or less C; from 0.05 to 0.50% Mn, 0.010% or less S; from 0.010 to 0.08% Sol.Al, 0.0050% or less N; wherein Mn %/S percent is ≧7 and (Sol.Al % - 0.003%)/N %≧6; the remainder iron and inevitable impurities; making the melt with ordinary ingot casting or continuous casting into a steel piece; hot rolling the steel piece and then cold-rolling it; decarburizing and annealing the cold-rolled sheet to a C content of 0.005% or below in decarbonization-annealing furnace; and again cold-rolling the steel into a sheet of 0.2 millimeters or less in thickness.

* * * * *